US007824227B1

(12) United States Patent
Lee et al.

(10) Patent No.: US 7,824,227 B1
(45) Date of Patent: Nov. 2, 2010

(54) USB APPLICATION DEVICE WITH A FLEXIBLE SUPPORTER UNDER A PRINTED CIRCUIT BOARD

(75) Inventors: Tsung-Shih Lee, Taipei (TW); Yu-Hsiang Ting, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/538,866

(22) Filed: Aug. 11, 2009

(51) Int. Cl.
*H01R 24/00* (2006.01)

(52) U.S. Cl. ..... 439/660

(58) Field of Classification Search ..... 439/660, 439/76.1, 751, 519, 520, 521; 361/752
See application file for complete search history.

(56) References Cited

U.S. PATENT DOCUMENTS 6,778,401 B1 * 8/2004 Yu et al. ..... 361/752
6,854,984 B1 * 2/2005 Lee et al. ..... 439/79
7,004,794 B2 * 2/2006 Wang et al. ..... 439/660
7,165,998 B2 * 1/2007 Lee et al. ..... 439/660
7,359,208 B2 * 4/2008 Ni ..... 361/752
7,407,390 B1 * 8/2008 Ni ..... 439/76.1
7,503,780 B1 * 3/2009 Huang ..... 439/135
7,537,488 B2 * 5/2009 Iwakawa ..... 439/660

* cited by examiner

*Primary Examiner*—Chandrika Prasad

(57) ABSTRACT

A USB application device includes a casing, a printed circuit board and a flexible supporter. The casing has a receiving space therein. The printed circuit board is completely receiving the printed circuit board and includes a top surface and a bottom surface opposite to the top surface. A plurality of contacts is disposed on the top surface of the printed circuit board. The flexible supporter is arranged in the casing and between the casing and the bottom surface of the printed circuit board. If the USB application device couples with a mating connector, the mating connector press the printed circuit board to urge the printed circuit board to press the flexible supporter. The flexible supporter is urged to be deformed by the press of the printed circuit board and to disperse the pressing force from the mating connector.

19 Claims, 5 Drawing Sheets

USB APPLICATION DEVICE WITH A FLEXIBLE SUPPORTER UNDER A PRINTED CIRCUIT BOARD

BACKGROUND OF THE INVENTION

1. Field of the Invention

The present invention relates to a USB application device, more specifically, to a miniaturized USB application device.

2. The Related Art

Because Universal serial bus (USB) interface has many advantages such as better convenience, compatibility and transmission speed, it is widely applied to various electronic devices such as personal computers, MP3 players, MP4 players, external storage devices, laptops, flash storage devices, etc. Hence, USB interface becomes one of the standard interfaces of the electronic devices.

A conventional USB compatible application apparatus is disclosed in U.S. Pat. No. 7,165,998. The USB compatible application apparatus has a printed circuit board (PCB) to be inside a connector. A top surface of the PCB carrying board includes a plurality of terminals. A board bottom sandwich is formed between a bottom surface of the PCB carrying board inside the connector and a covering shell of the connector. At least one electrical element is fixed on the bottom surface of the PCB carrying board inside the connector.

Therefore, the present invention can shorten the length of the USB compatible application device and efficiently raise working efficiency of the USB compatible application device. The thickness of the connector is further reduced because the thickness of the PCB carrying board is approximately 0.3 millimeter (mm) to 1 mm.

Furthermore, the board bottom sandwich has at least one supporting structure, front end protection layer, and a combination thereof capable of connecting to the PCB carrying board. Hence, the supporting structure can fix the size of the board bottom sandwich and prevent the board bottom sandwich from deforming by the outer force. The front end protection layer can protect the electrical element inside the board bottom sandwich and meanwhile efficiently strengthen the structure of the board bottom sandwich.

However, the front end protection layer and the supporting structure merely support a front side and opposite lateral sides of the PCB carrying board inside the connector. There is not any supporting structure located in the central area of the board bottom sandwich for supporting the central portion of the PCB carrying board inside the connector.

If a corresponding USB connecting bracket plugs into a connecting sandwich formed between the top surface and the covering shell inside the connector, then the terminals of the corresponding USB connecting bracket will press the PCB carrying board inside the connector. Hence, the central portion of the PCB carrying board inside the connector is likely to be damaged because the PCB carrying board is thin and approximately 0.3 mm to 1 mm and there is not any supporting structure supporting the central portion of the PCB carrying board inside the connector to resist the pressing force generated from the USB connecting bracket.

SUMMARY OF THE INVENTION

An object of the present invention is to provide a USB application device has a compact size and is capable of dispersing an external pressing force.

According to the invention, the USB application device has a casing, a printed circuit board and a flexible supporter. The casing has a receiving space therein for completely receiving the printed circuit board. The printed circuit board has a top surface disposed a plurality of contacts, and a bottom surface opposite to the top surface. The flexible supporter is arranged in the casing and between the casing and the bottom surface of the printed circuit board.

If the USB application device couples with a mating connector, then the mating connector may press the top surface of the printed circuit board to urge the printed circuit board to press the flexible supporter. Hence, the flexible supporter is urged to be deformed by the press of the printed circuit board and to disperse the pressing force from the mating connector for preventing the printed circuit board form being damaged by the pressing force.

BRIEF DESCRIPTION OF THE DRAWINGS

The present invention will be apparent to those skilled in the art by reading the following description of preferred embodiments thereof, with reference to the attached drawings, in which:

FIG. 2 shows an exploded view of the USB application device in

FIG. 1;

DETAILED DESCRIPTION OF THE PREFERRED EMBODIMENT

Figure 1:
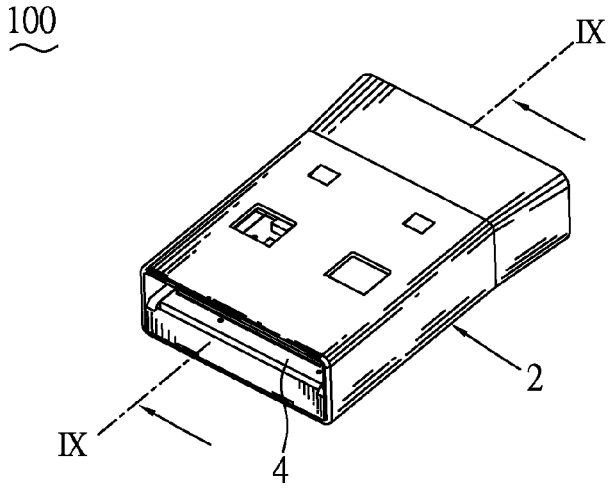
FIG. 1 shows a perspective view of a first preferred embodiment of a USB application device according to the present invention.
Figure 2:
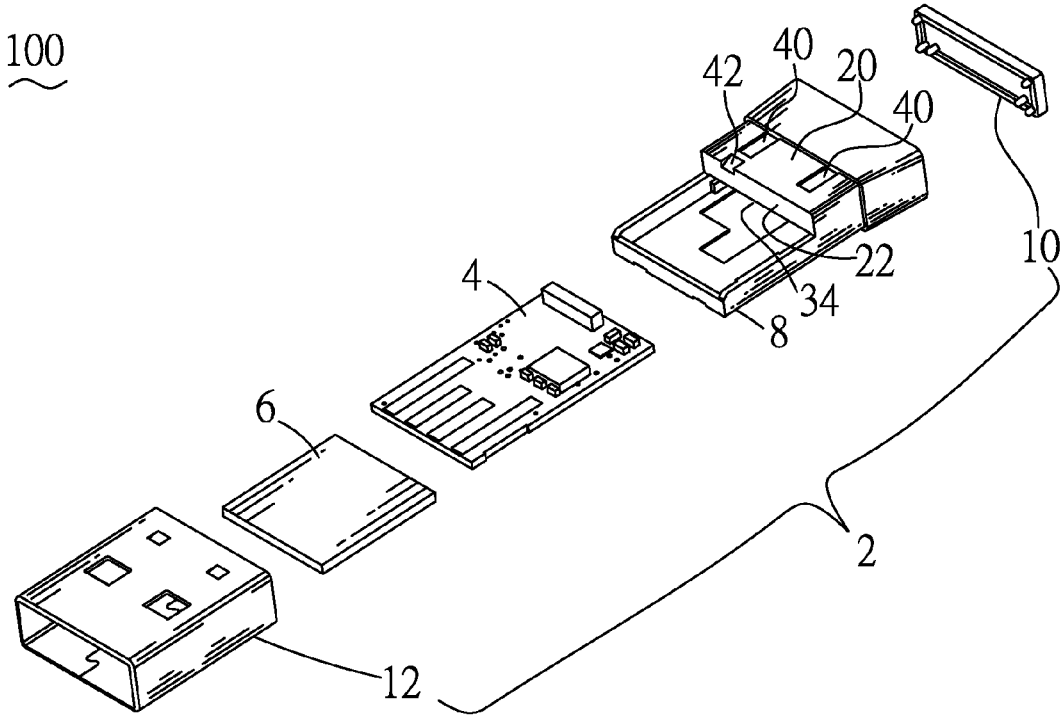

Please refer to FIG. 1 and FIG. 2. A first preferred embodiment of a USB application device 1 is a wireless USB dongle. The wireless USB dongle is one of standard specifications of Bluetooth, radio-frequency identification (RFID), WiFi, worldwide interoperability for microwave access (WiMAX), ZigBee, global system for mobile communications (GSM), General packet radio service (GPRS), 3rd generation partnership project (3GPP), global positioning system (GPS), etc.

The USB application device 1 has a casing 2, a PCB 4 and a flexible supporter 6. The PCB 4 and the flexible supporter 6 are received in the casing 2. The casing has a housing 8, a rear cover 10 and a shell 12. The housing 8 and the rear cover 10 are made of an isolated material. The shell 12 is made of a metal material. The flexible supporter is also made of an isolated material.

Figure 3:
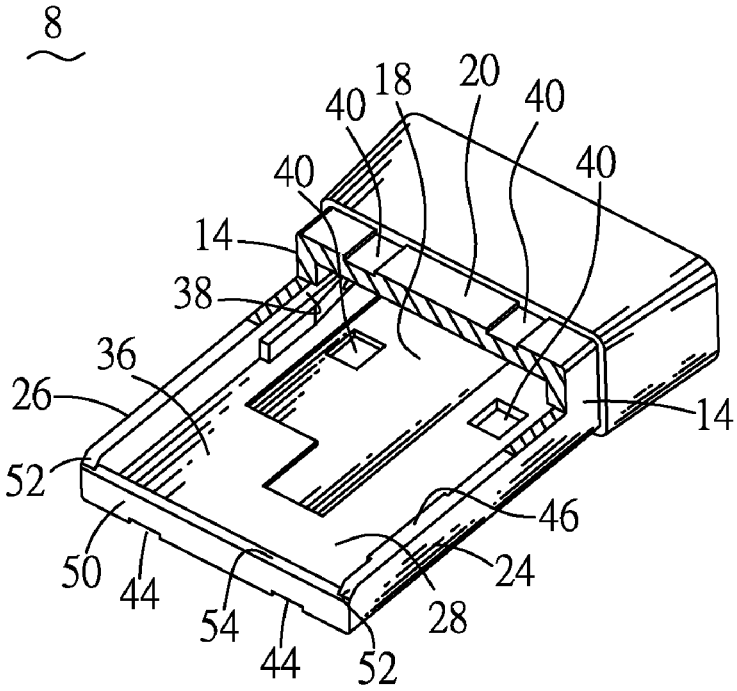
FIG. 3 shows a perspective view of a housing of the USB application device being cut a fixing wall and a front portion of a top wall in FIG. 1.
Figure 4:
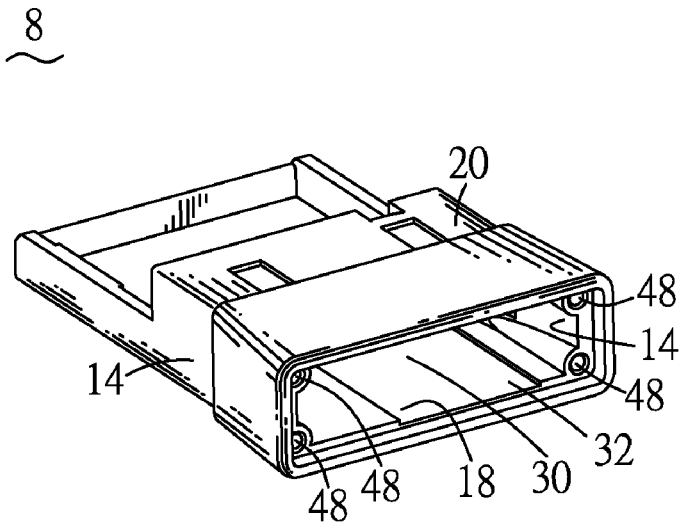
FIG. 4 is a rear view of the housing of the USB application device in FIG. 1.
Figure 9:
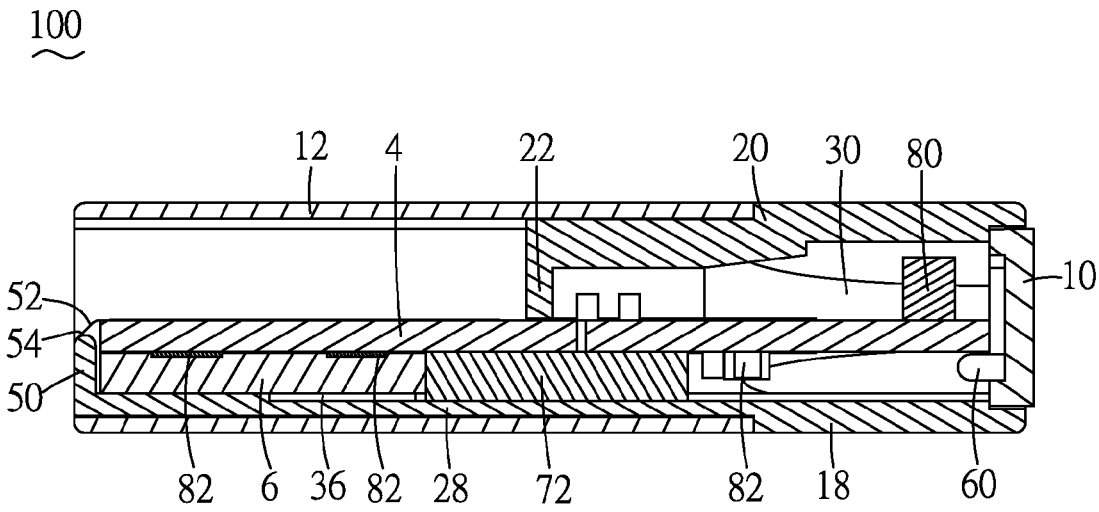
FIG. 9 is a cross-sectional view of the USB application device taken along line IX-IX in FIG. 1.

Please refer to FIG. 3, FIG. 4 and FIG. 9. The housing 2 has two side walls 14, a bottom wall 18, a top wall 20, a fixing wall 22, a first front side wall 24, a second front side wall 26 and a front bottom wall 28. The bottom wall 18 is opposite to the top wall 20. The side walls 14 respectively connect opposite sides of the bottom wall 18 and the top wall 20.

The side walls 14, the bottom wall 18 and the top wall 20 defined a rear receiving space 30 and a rear opening 32 defined among the rear edge portions of the side walls 14, the bottom wall 18 and the top wall 20 and connected to the rear receiving space 30.

The fixing wall 22 extends from an inner surface of the top wall 20. Especially, the fixing wall 22 perpendicularly extends from a front edge portion of the top wall 20 and towards the bottom wall 18. Opposite edge portions of the fixing wall 22 connect to the front edge portions of the two opposite side walls 14 respectively. Front edge portions of the first side walls 14, the bottom wall 18 and a bottom edge portion of the fixing wall 22 surround a front opening 34 connected to the rear receiving space 30.

The first front side wall 24, the second front side wall 26 and the front bottom wall 28 extend from the front edge portions of the side walls 14 and the bottom wall 18 respectively and defined a front receiving space 36. The front receiving space 36 connects to the front opening 34. The two opposite side walls 14 are the same height. The first front side wall 24 and the second front side wall 26 are the same height, but lower than the first side wall 14 and the second side wall 16.

Each of inner surfaces of the two side walls 14 forms a channel 38. Each of outer surfaces of the bottom wall 18 and the top wall 20 is formed a pair hollows 40. A first guiding portion 42 is formed at an outer surface of a corner between the top wall 20 and the fixing wall 22 and aligned with one of the hollows 34 formed on the top wall 20. Especially, the first guiding portion is a slanted surface.

An outer surface of the front bottom wall 28 is formed a second guiding portion 44. Especially, the second guiding portion 44 is a pair grooves aligned with the hollows formed on the bottom wall 18 respectively. One end of each of the grooves opens at a front edge portion of the front bottom wall 28, and the other end straightly extends towards the corresponding hollow 40.

An inner surface of the first front side wall 24 projects a projection 46. Each of corners between rear edge portions of the side wall 14 and the bottom wall 18, and between the side wall 14 and the top wall 20 is formed a hole 48 respectively.

The front edge portion of the front bottom wall 28 upwardly extends a front wall 50. Opposite edge portions of the front wall 40 connect to front edge portions of the first front side wall 24 and the second front side wall 26. Each of corners formed between a top edge portion of the front wall 50 and a top edge portion of the first front side wall 24, and between the top edge portion of the front wall 50 and the second front side wall 26 is formed a third guiding portion 52. The top edge portion of the front wall 50 is formed a fourth guiding portion 54. Especially, the third guiding portion 52 and the third guiding portion 54 are of a arched surface.

Figure 5:
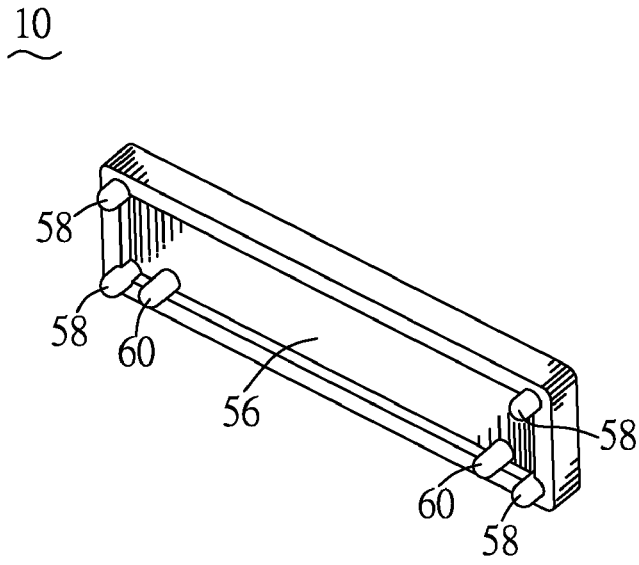
FIG. 5 is a perspective view of a rear cover of the USB application device in FIG. 1.

Please refer to FIG. 5. The rear cover 10 has a body portion 56, a plurality of pillars 58 and a supporting portion 60. The body portion 56 is of a plate. The profile of the body portion 56 matches up the profile of the rear opening 32 of the housing 8. In this case, the housing 8 and the rear opening 32 are substantially of a rectangular shape, and therefore, the body portion 56 of the rear cover 10 is also of a rectangular shape.

The pillars 58 are aligned with the holes 48 of the housing 8 respectively. Hence, the pillars 58 are projected from one surface of four corners of the body portion 56 respectively and are perpendicular to the body portion 56. The supporting portion 60 is projected from the surface of the body portion 56. Especially, the supporting portion 60 is of a pillar.

Figure 6:
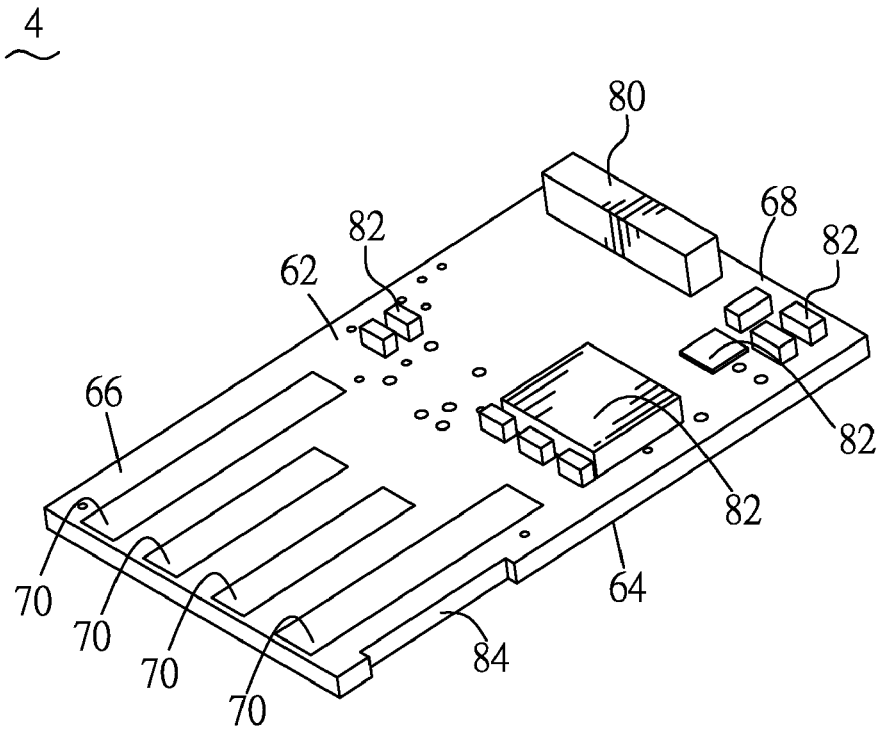
FIG. 6 shows a printed circuit board of the USB application device in FIG. 1.

Please refer to FIG. 6. The PCB 4 has a top surface 62, a bottom surface 64 opposite to the top surface 62, a front end portion 66 and a rear end portion 68 opposite to the front end portion 66. The top surface 62 of the front end portion 66 is disposed four contacts 70. The contacts 70 functions as power contact (VCC), ground contact (GND) and differential signal transmission contacts (D+, D−) respectively to comply with USB standard specification. An integrated circuit (IC) 72 is located on the bottom surface 64 of the PCB 4 and between the front end portion 66 and the rear end portion 68.

Figure 7:
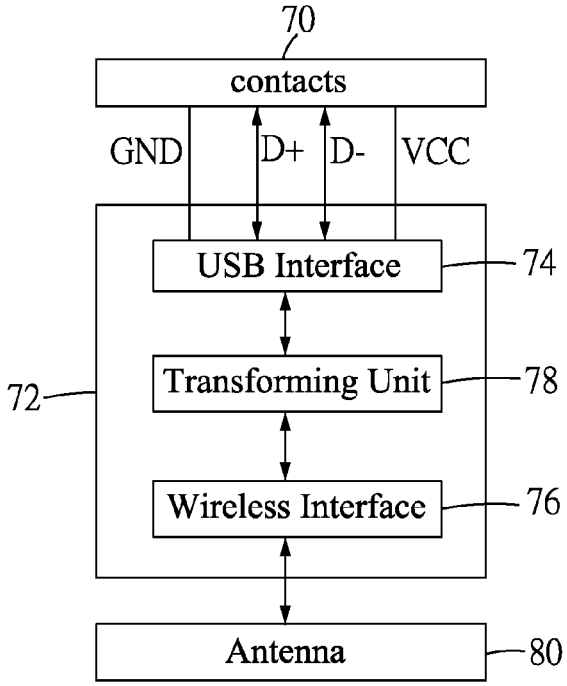
FIG. 7 shows a block diagram of an integrated circuit of the USB application device in FIG. 1.

Please refer to FIG. 7. The IC 72 has a USB interface 74, a wireless interface 76 and a transforming unit 78 interconnecting the USB interface 74 and the wireless interface 76. In this case, the wireless interface 76 is a Bluetooth interface. The transforming unit 78 can receive USB signal form the USB interface 74 and transforming USB signal to Bluetooth signal, and then send Bluetooth signal to the wireless interface 76.

The transforming unit 78 also can receive Bluetooth signal form the wireless interface 76 and transforming Bluetooth signal to USB signal, and then send USB signal to the USB interface 74. Hence, the transforming unit 78 functions as a bridge between the USB interface 74 and the wireless interface 76. Additionally, the wireless interface 76 can be one of RFID, WiFi, WiMAX, ZigBee, GSM, GPRS, 3GPP, GPS.

The USB interface 74 of the IC 72 connects the contacts 70 via a set of conducting traces (not shown in figures) printed on the PCB 4. The top surface 62 of the rear end portion 68 is disposed an antenna 80 connecting to the wireless interface 76 of the IC 72 via another conducting trace (not shown in figures). The antenna 80 can transmit and receive wireless Bluetooth signal.

The top surface 62, and the bottom surface 64 of the front end portion 66 are disposed a plurality of electrical elements 82. A peripheral portion of the antenna 80 at the top surface 62 and the bottom surface 64 of the PCB 4 is not disposed any electrical element 82 for preventing the antenna 80 from interference. One side edge of the front end portion 66 of the PCB 4 is formed an indentation 84.

Figure 8:
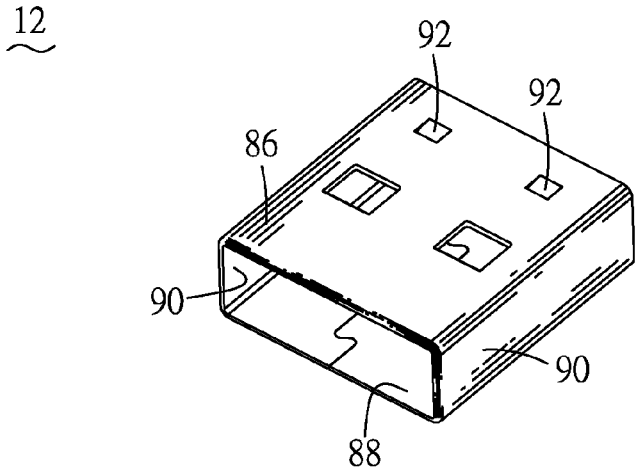
FIG. 8 is a perspective view of a shell of the USB application device in FIG. 1.

Please refer to FIG. 8. The shell 12 has a top plate 86, a bottom plate 88 opposite to the top plate 86 and opposite side plates 90. The side plates 90 connect opposite edges of the top plate 86 and the bottom plate 88 respectively. The top plate 86 and the bottom plate 88 define a pair of wedges 92 respectively (only shown the wedges at the top plate).

If an external force presses the flexible supporter 6, the flexible is deformed for dispersing the external force. Especially, the flexible supporter 6 can be a Mylar, a rubber and a flexible plastic.

The fabricating method of the USB application device 1 are described as following. First, the flexible supporter 6 is arranged in the front receiving space 36 of the housing 8. Second, the PCB 4 is inserted into the housing 8 from the rear opening 32 and meanwhile the side edges of the PCB 4 are slid into and received in the channels 38. The channels 38 can fix the PCB 4 to prevent the PCB 4 from shifting in a first direction defined from the bottom wall 18 to the top wall 20.

The opposite side edges of the PCB 4 abut against the inner surfaces of the two side walls 14, the first front side wall 24 and the second front side wall 26 to prevent the PCB 4 from shifting in a second direction defined from the first side wall 14 to the second side wall 16.

The rear end portion 68 of the PCB 4 is completely received in the rear receiving space 30 of the housing 8. The front end portion 66 of the PCB 4 is received in the front receiving space 36 of the housing 8 and arranged upon the flexible supporter 6. The contacts 70 are exposed outside of the front receiving space 36. The flexible supporter 6 is stuffed in the front receiving space 36 and located between the PCB 4 and the front bottom wall 28 of the housing 8.

The projection 46 of housing 8 is engaged into the indentations 84 of the PCB 4 to prevent the PCB 4 form shifting in a third direction defined from the front wall 50 to the rear opening 32. The IC 72 further has a printed surface. Generally speaking, the printed surface is printed or carved serial number, manufacturer's name, manufacturer's mark of the IC 72. The printed surface of the IC 56 abuts against the inner surfaces of the bottom wall 18 and the front bottom wall 28.

Hence, the IC 72 supports the middle portion of the PCB 4 between the front end portion 50 and the rear end portion 52. The bottom edge portion of the fixing wall 22 abuts against the middle portion of the top surface 62 of the PCB 4. The middle portion of the PCB 4 and the IC 72 are together sandwiched in the front opening 34 of the housing 8.

Third, the rear cover 10 covers the rear opening 32 of the housing 8. The pillars 58 are engaged into the holes 48 of the housing 8. The supporting portion 60 of the rear cover 10 supports the rear end portion 68 of the PCB 4.

Finally, the front end portion 66 of the PCB 4 and the first front side wall 24, the second front side wall 26, the front bottom wall 28 and the front wall 50 are received into the shell 12. The wedges 92 formed on the top plate 86 and the bottom plate 88 are guided by the first guiding portion 42 and the second guiding portion 44 of the housing 8, and then engaged into the hollows 40 formed on the top wall 20 and the bottom wall 18 of the housing 8. Therefore, the shell 12 is fixed with the housing 8.

The contacts 70, the front end portion 66 of the PCB 4 and the shell 12 form as a standard A-type USB connector. The shell 12 can enhance ESD protection and therefore the USB application device 1 can comply with USB standard specification.

If the USB application device 1 couples to the electrical apparatuses, a carrying housing or a carrying board of a mating connector of the electronic apparatuses (not shown in figures) is guided to plug into a space between the top surface 58 of the PCB 4 and the shell 12 by the third guiding portion 52 and the fourth guiding portion 54. Hence, mating contacts of the mating connector can couple to the contacts 70 of the PCB 4 of the USB application device 1.

The mating contacts of the mating connector presses the front end portion 66 of the PCB 4 to shift towards the front bottom wall 28 and to press the flexible supporter 6. Hence, the flexible supporter 6 is likely to deform due to the press of the PCB 4 and is capable of dispersing the pressing force from the mating contacts of the mating connector.

Figure 10:
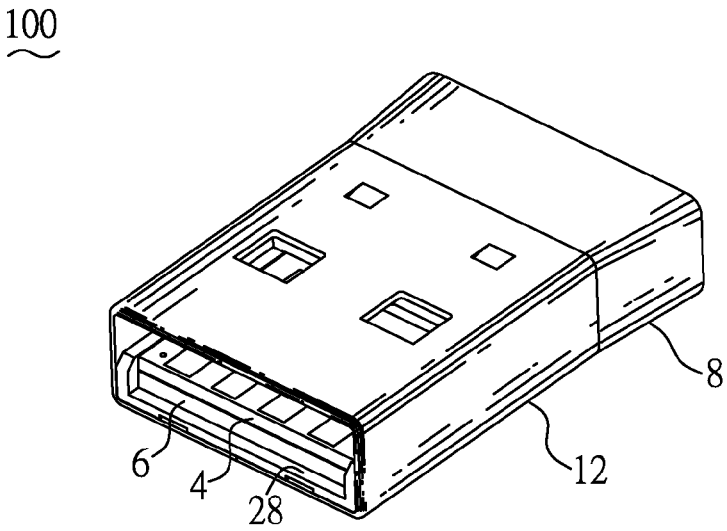
FIG. 10 shows a perspective view of a second preferred embodiment of a USB application device according to the present invention.

Please refer to FIG. 10. In a second preferred embodiment of the USB application device 1, the front wall 50 of the housing 8 may be removed. The flexible supporter 6 is fixed on the inner surface of the front bottom wall 28 by a glue. Therefore, the flexible supporter 6 can not only protect the electrical element 82 disposed on the bottom surface 64 of the front end portion 66 of the PCB 4 if the USB application device 1 couples with the mating connector, but also can fix the PCB 4.

As described above, if the mating connector couples with the USB application device and presses the front end portion 66 of the PCB 4, the PCB 4 may shift towards and presses the flexible supporter 6. The flexible supporter 6 is deformed due to the press of the PCB 4 and is capable of dispersing the pressing force from the mating connector to prevent the PCB form being damaged by the pressing force.

Furthermore, the present invention is not limited to the embodiments described above; diverse additions, alterations and the like may be made within the scope of the present invention by a person skilled in the art. For example, respective embodiments may be appropriately combined.

What is claimed is:

1. A USB application device coupled with a mating connector, comprising:

a casing formed with a receiving space therein;

a printed circuit board completely received in the receiving space of the casing and comprising a top surface and a bottom surface opposite to the top surface;

a plurality of contacts disposed on the top surface of the printed circuit board; and a flexible supporter arranged in the receiving space which is located between a bottom surface of the printed circuit board and the casing;

wherein if the printed circuit board receives a pressing force from the mating connector to press the flexible supporter, the flexible supporter is deformed to disperse the pressing force from the mating connector.

2. The USB application device as claimed in claim 1, wherein the casing has a housing and a shell coupled with the housing, the printed circuit board has a front end portion and a rear end portion opposite to the front end portion, the contacts are disposed on the top surface of the first end portion of the printed circuit board, the rear end portion of the printed circuit board is received in housing, and the contacts are exposed outside the housing and received in the shell.

3. The USB application device as claimed in claim 2, wherein the housing comprises a bottom wall, a top wall opposite to the top wall, opposite side walls connected to opposite edges of the bottom wall and the top wall respectively to form a rear receiving space for receiving the rear end portion of the printed circuit board, a front bottom wall extending from a front edge portion of the bottom wall, and opposite front side walls extending from front edge portions of the side walls and connected to opposite side edges of the front bottom wall to form a front receiving space for receiving the front end portion of the printed circuit board, the contacts are exposed outside the front receiving space and received in the shell covering the front bottom wall and front side walls of the housing.

4. The USB application device as claimed in claim 3, wherein the flexible supporter is arranged in the front receiving space.

5. The USB application device as claimed in claim 4, further comprising an integrated circuit fixed on the bottom surface of a middle portion of the printed circuit board, a fixing wall extending from the top wall and towards the bottom wall, a gap formed between a bottom edge portion of the fixing wall connecting the top surface of the middle portion of the printed circuit board, and the bottom wall connected to the integrated circuit to interconnect the rear receiving space and the front receiving space, and to sandwich the middle portion of the printed circuit board and the integrated circuit.

6. The USB application device as claimed in claim 5, further comprising a channel formed on each of inner surfaces of the side walls for receiving corresponding one of side edges of the printed circuit board.

7. The USB application device as claimed in claim 5, further comprising at least one hollow formed on outer surfaces of the bottom wall and the top wall and at least one wedge formed on a bottom plate of the shell and a top plate of the shell opposite to the bottom plate for engaging into the corresponding hollow.

8. The USB application device as claimed in claim 5, further comprising at least one indentation formed on one of the side edges of the printed circuit board, and at least one projection projected from one of inner surfaces of the side walls for engaging into the indentation.

9. The USB application device as claimed in claim 7, further comprising at least one first guiding portion formed on the top wall of the housing, at least one second guiding portion formed on the front bottom wall, and at least one third guiding portion formed on front edge portions of the front side walls.

10. The USB application device as claimed in claim 5, further comprising a front wall upwardly extending from a front edge portion of the front bottom wall.

11. The USB application device as claimed in claim 5, further comprising a guiding portion formed at a top portion of the front wall.

12. The USB application device as claimed in claim 5, further comprising a rear opening being surrounded by the rear edge portions of the bottom wall, top wall and side walls, and a rear cover covering the rear opening.

13. The USB application device as claimed in claim 1, wherein the flexible supporter is selectively one of a Mylar, a rubber and a flexible plastic.

14. The USB application device as claimed in claim 13, wherein at least one hole formed at rear edge portions of the bottom wall, top wall and side walls, the rear cover has a body portion and at least one pillar projected from the body portion and engaged into the hole.

15. The USB application device as claimed in claim 5, wherein the top surface of the rear end portion of the printed circuit is disposed with an antenna.

16. The USB application device as claimed in claim 5, wherein the bottom surface of the front end portion of the printed circuit board is disposed with at least one electrical element.

17. The USB application device as claimed in claim 4, wherein the front side walls are lower than the side walls.

18. A wireless USB dongle coupled with a mating connector of an electrical device, comprising:

an isolated housing having a rear portion formed with a rear receiving space, and a front portion formed with a front receiving space connected to the rear receiving space;

a printed circuit board having a top surface, a bottom surface opposite to the top surface, a front end portion and a rear end portion opposite to the front end portion;

a plurality of contacts disposed on the top surface of the printed circuit board;

an integrated circuit disposed on a middle portion of the printed circuit board;

an antenna disposed on the rear end portion of the printed circuit board;

at least one electrical element disposed on the bottom surface of the front end portion of the printed circuit board;

a flexible supporter arranged in the front receiving space and between bottom surface of the printed circuit board and the isolated housing; and a metal shell covering the front portion of the isolated housing;

wherein the rear end portion of the printed circuit board and the antenna are completely received in the rear receiving space of the isolated housing, one part of the integrated circuit is received in the rear receiving space, the other part of the integrated circuit is received in the front receiving space, a first side of the flexible supporter connects to the bottom surface of the printed circuit board and the electrical element, a second side of the flexible supporter opposite to first side connects to the isolated housing, and if the printed circuit board is urged to press the flexible supporter by receiving a pressing force from the mating connector, the flexible supporter is deformed to disperse the pressing force from the mating connector.

19. The USB application device as claimed in claim 18, further comprising at least one supporting portion projected from the body of the rear cover and supporting the rear end portion of the printed circuit board.

* * * * *